US008406641B2

(12) United States Patent
Hinoue et al.

(10) Patent No.: US 8,406,641 B2
(45) Date of Patent: Mar. 26, 2013

(54) IMAGE FORMING APPARATUS AND TONER SUPPLY METHOD

(75) Inventors: Kazuma Hinoue, Osaka (JP); Motoyuki Itoyama, Osaka (JP); Masayasu Narimatsu, Osaka (JP); Kohichi Takenouchi, Osaka (JP); Hideji Saikoh, Osaka (JP); Takeshi Ohkawa, Osaka (JP); Kiyofumi Morimoto, Osaka (JP); Tomoki Minamikawa, Osaka (JP); Mitsuru Tokuyama, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 293 days.

(21) Appl. No.: 12/912,949

(22) Filed: Oct. 27, 2010

(65) Prior Publication Data

US 2011/0123204 A1 May 26, 2011

(30) Foreign Application Priority Data

Nov. 24, 2009 (JP) ..... 2009-266057

(51) Int. Cl.
*G03G 15/08* (2006.01)

(52) U.S. Cl. ..... 399/27; 399/24; 399/30; 399/53; 399/255; 399/258

(58) Field of Classification Search ..... 399/24, 399/27, 30, 53, 255, 258
See application file for complete search history.

(56) References Cited

U.S. PATENT DOCUMENTS

| | | | | |
|---|---|---|---|---|
| 2009/0232524 | A1 * | 9/2009 | Takahashi et al. | 399/27 |
| 2010/0086322 | A1 * | 4/2010 | Koizumi et al. | 399/53 |

FOREIGN PATENT DOCUMENTS

| | | |
|---|---|---|
| JP | 2006-106194 | 4/2006 |
| JP | 2007-304524 | 11/2007 |
| JP | 2010-085538 | 4/2010 |

* cited by examiner

*Primary Examiner* — Ryan Walsh
(74) *Attorney, Agent, or Firm* — Renner, Otto, Boisselle & Sklar, LLP

(57) ABSTRACT

An image forming apparatus includes a developing device having a toner supply sensor, a toner supply device supplying toner to the developing device, a toner supply controller controlling toner supply from the toner supply device to the developing device based on predetermined conditions, a toner empty determiner determining whether toner is present inside the toner supply device. In the image forming apparatus, the toner supply device includes a storage for recording multiple measured values of toner supply detected by the toner supply sensor, and the toner supply controller corrects the amount of toner supply, based on the moving average of multiple measured values of the amount of toner supply.

6 Claims, 8 Drawing Sheets

IMAGE FORMING APPARATUS AND TONER SUPPLY METHOD

This Nonprovisional application claims priority under 35 U.S.C. §119(a) on Patent Application No. 2009-266057 filed in Japan on 24 Nov. 2009, the entire contents of which are hereby incorporated by reference.

BACKGROUND OF THE INVENTION (1) Field of the Invention

The present invention relates to an image forming apparatus, and in particular relates to an image forming apparatus such as an electrostatic copier, laser printer, facsimile machine or the like that includes a developing device using a dual-component developer containing a toner and a magnetic carrier and forms images based on electrophotography using toner as well as relating to a toner supply method for the image forming apparatus.

(2) Description of the Prior Art

Conventionally, image forming apparatuses based on electrophotography such as copiers, printers, facsimile machines and the like have been known. The image forming apparatus based on electrophotography is constructed so as to form an image by forming an electrostatic latent image on the surface of a photoreceptor, e.g., photoreceptor drum, supplying toner to the photoreceptor drum from a developing device to develop the electrostatic latent image, transferring the toner image formed on photoreceptor drum by development to a sheet of paper etc., and fixing the toner image onto the sheet by means of a fixing device.

Recently, in the image forming apparatuses supporting full-color and high-quality images, a dual-component developer (which will be referred to hereinbelow simply as "developer"), which presents excellent charge performance stability, is often used.

This developer consists of a toner and a carrier, which are agitated in the developing device and frictionally rubbed with each other to thereby produce appropriately electrified toner.

The electrified toner in the developing device is supplied to a dual-component developer supporting member, e.g., the surface of a developing roller. The toner thus supplied to the developing roller is moved by electrostatic attraction to the electrostatic latent image formed on the photoreceptor drum. Hereby, a toner image based on the electrostatic latent image is formed on the photoreceptor drum.

Further, recently, image forming apparatuses are demanded to be made compact and operate at high speeds, hence it is necessary to electrify the developer quickly and sufficiently and also convey the developer quickly and smoothly.

To deal with this, in order to disperse supplied toner promptly into the developer and provide the toner with an appropriate amount of charge, a circulating type developing device has been adopted in image forming apparatuses.

This circulating type developing device includes: a developer conveying passage in which the developer is circulatively conveyed; a screw auger (developer conveying member) for conveying the developer while agitating in the developer conveying passage; a toner supply port for leading toner from a toner container into the developer conveying passage; and a toner concentration detecting sensor for detecting the toner concentration of the developer. In this arrangement, when the toner concentration of the developer becomes lower than a predetermined level, toner supply is directed to the toner cartridge so that toner is supplied to the developer conveying passage and the supplied toner is conveyed whilst being agitated (see Patent Document 1: Japanese Patent Application Laid-open 2006-106194).

In the aforementioned circulating type developing device using the dual-component developer, if toner to be supplied from the toner cartridge to the developing device is used up, the toner concentration in the developer gradually degreases, so that carrier transfer phenomena (carrier adherence) to the photoreceptor drum occur more frequently. As a result, it is necessary to perform toner empty decision.

Toner empty decision is to decide (detect) the state of toner empty when, for example, the toner concentration of the developer detected by the toner supply sensor does not increase after toner supply was directed to the toner cartridge.

However, if the toner concentration detecting sensor is located away from the toner supply port through which toner is supplied, toner empty decision is delayed because the fall in toner concentration detected by the toner concentration detecting sensor is slow, posing the problem that carrier adhesion occurs more frequently.

On the other hand, when the amount of supplied toner is detected by a sensor disposed near the toner supply port, it is necessary to use the average (moving average) of the latest multiple sampled values in order to improve detection accuracy. Correcting toner supply control based on this average value makes it possible to stabilize the amount of supplied toner.

However, when the toner cartridge is replaced by another one, the moving average is not pertinent, so that there is a fear of excessive toner supply or insufficiency of toner supply occurring during the period after replacement of the toner cartridge until the moving average converges to the normal value after multiple number of samplings.

SUMMARY OF THE INVENTION

The present invention has been devised in view of the above problem, it is therefore an object of the present invention to provide an image forming apparatus and a toner supply method that can suitably correct the amount of toner to be supplied, in accordance with the variation in the amount of supplied toner from each individual toner cartridge even when the toner cartridge for supplying toner to the developer is changed from one to another, so as to be able to stabilize the amount of supplied toner.

According to the present invention, the image forming apparatus and toner supply method for solving the above problem are configured as follows:

The first aspect of the present invention resides in an image forming apparatus comprising: a developing device; a toner supply device that is detachably mounted to the image forming apparatus and supplies toner to the developing device; a toner supply controller that controls the toner supply from the toner supply device to the developing device based on predetermined conditions; a toner empty determiner that determines that no toner is left in the toner supply device when the amount of toner supplied from the toner supply device to the developing device is lower than a threshold, characterized in that the developing device comprises: a developer container for storing a developer including the toner and a magnetic carrier; a toner supply port that leads the toner supplied from the toner supply device into the developer container; and, a toner supply sensor arranged near the toner supply port to detect the amount of toner supply, the toner supply device includes a storage for recording the amount of toner supply detected by the toner supply sensor every time a toner supply operation is made, and, the toner supply controller corrects the amount of toner supplied from the toner supply device to the developing device, based on the moving average of multiple toner supplies recorded in the storage.

The second aspect of the present invention is characterized in that the moving average is the average of multiple toner supplies detected from the latest multiple toner supply operations.

The third aspect of the present invention is characterized in that the toner supply sensor detects the magnetic permeability of the developer residing in the developer container.

The fourth aspect of the present invention is characterized in that the toner supply device includes: a toner discharger that turns to discharge the toner inside the toner supply device to the developing device side; and, a drive motor for rotating the toner discharger, and the toner supply controller corrects the amount of toner supply by varying either the rotational rate or rotating time of the drive motor.

The fifth aspect of the present invention is characterized in that the storage comprises a non-volatile memory provided in the toner supply device.

The sixth aspect of the present invention resides in a toner supply method for an image forming apparatus, the image forming apparatus comprising: a developing device; a toner supply device that is detachably mounted to the image forming apparatus and supplies toner to the developing device; a toner supply controller that controls the toner supply from the toner supply device to the developing device based on predetermined conditions; a toner empty determiner that determines that no toner is left in the toner supply device when the amount of toner supplied from the toner supply device to the developing device is lower than a threshold, wherein the developing device comprises: a developer container for storing a developer including the toner and a magnetic carrier; a toner supply port that leads the toner supplied from the toner supply device into the developer container; and, a toner supply sensor arranged near the toner supply port to detect the amount of toner supply, the toner supply device includes a storage for recording the amount of toner supply detected by the toner supply sensor every time a toner supply operation is made, and, the toner supply controller corrects the amount of toner supplied from the toner supply device to the developing device, based on the moving average of multiple toner supplies recorded in the storage, the toner supply method comprising the steps of: recording the amount of supplied toner detected by the toner supply sensor every time a toner supply operation is made; and, correcting the amount of toner to be supplied from the toner supply to the developing device, based on the moving average.

According to the first aspect of the present invention, since it is possible to make appropriate correction in accordance with variation in the amount of toner supply of each individual toner supply device, based on the moving average recorded in the storage even if the toner supply device is replaced, it is possible to constantly keep the stable amount of toner supply and hence prevent change in image quality due to variation of toner concentration. Further, it is possible to reduce variation in the amount of toner supply so as to stabilize the amount of toner supply.

According to the second aspect of the present invention, variation of the amount of toner supply is further reduced so as to be able to stabilize the amount of toner supply.

According to the third aspect of the present invention, it is possible to detect toner supply in a simple manner by detecting change in toner concentration.

According to the fourth aspect of the present invention, it is possible to easily stabilize the amount of toner supply.

According to the fifth aspect of the present invention, it is possible to provide a simple apparatus configuration.

According to the sixth aspect of the present invention, since it is possible to make appropriate correction in accordance with variation in the amount of toner supply of each individual toner supply device, based on the moving average recorded in the storage even if the toner supply device is replaced, it is possible to constantly keep the stable amount of toner supply and hence prevent change in image quality due to variation of toner concentration.

DESCRIPTION OF THE PREFERRED EMBODIMENTS

Now, the embodied mode for carrying out the present invention will be described with reference to the drawings.

Figure 1:
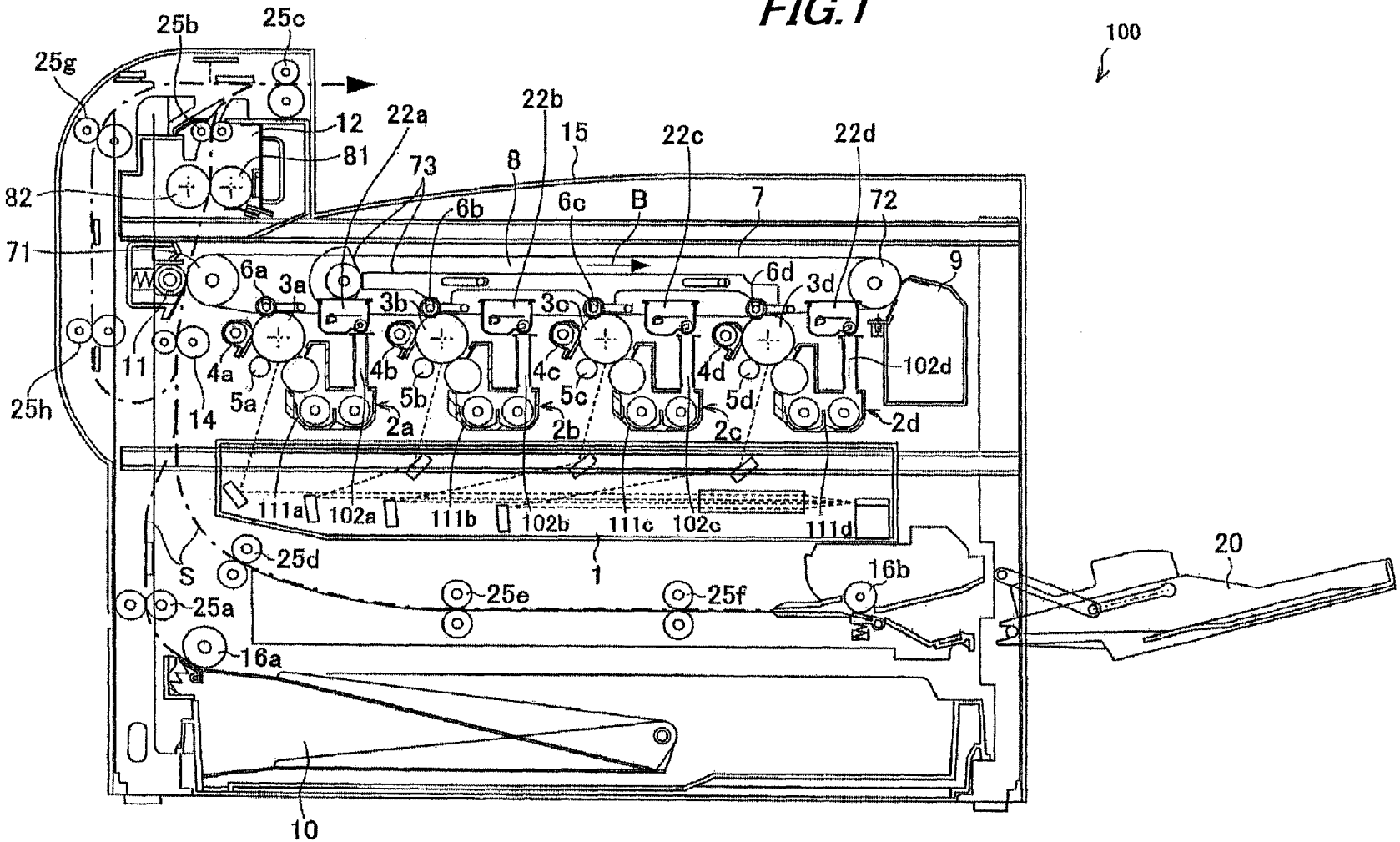
FIG. 1 is an illustrative view showing the overall configuration of an image forming apparatus according to the embodiment of the present invention.

FIG. 1 shows one exemplary embodiment of the present invention, and is an illustrative view showing the overall configuration of an image forming apparatus according to the embodiment of the present invention.

An image forming apparatus 100 of the present embodiment forms an image with toners based on electrophotography, including: as shown in FIG. 1, photoreceptor drums 3*a*, 3*b*, 3*c* and 3*d* (which may be also called "photoreceptor drums 3" when general mention is made) for forming electrostatic latent images on the surfaces thereof; chargers (charging devices) 5*a*, 5*b*, 5*c* and 5*d* (which may be also called "chargers 5" when general mention is made) for charging the surfaces of photoreceptor drums 3; an exposure unit (exposure device) 1 for forming electrostatic latent images on the photoreceptor drum 3 surfaces; developing devices 2*a*, 2*b*, 2*c* and 2*d* (which may be also called "developing devices 2" when general mention is made) for supplying toners to the electrostatic latent images on the photoreceptor drum 3 surfaces to form toner images; toner supply devices (e.g., toner cartridges) 22*a*, 22*b*, 22*c* and 22*d* (which may be also called "toner supply devices 22" when general mention is made) for supplying toners to developing devices 2; an intermediate transfer belt unit (transfer device) 8 for transferring the toner images from the photoreceptor drum 3 surfaces to a recording medium; and a fixing unit (fixing device) 12 for fixing the toner image to the recording medium.

This image forming apparatus 100 forms a multi-color or monochrome image on a predetermined sheet (recording paper, recording medium) in accordance with image data transmitted from the outside. Here, image forming apparatus 100 may also include a scanner or the like on the top thereof.

To being with, the overall configuration of image forming apparatus 100 will be described.

As shown in FIG. 1, image forming apparatus 100 separately handles image data of individual color components, i.e., black (K), cyan (C), magenta (M) and yellow (Y), and forms black, cyan, magenta and yellow images, superimposes these images of different color components to produce a full-color image.

Accordingly, image forming apparatus 100 includes, as shown in FIG. 1, four developing devices 2 (2*a*, 2*b*, 2*c* and 2*d*), four photoreceptor drums 3 (3*a*, 3*b*, 3*c* and 3*d*), four chargers 5 (5*a*, 5*b*, 5*c* and 5*d*) and four cleaner units 4 (4*a*, 4*b*, 4*c* and 4*d*) to form images of four different colors. In other words, four image forming stations (image forming portions) each including one developing device 2, one photoreceptor drum 3, one charger 5 and one cleaner unit 4 are provided.

Here, the symbols a to d are used so that 'a' represents the components for forming black images, 'b' the components for forming cyan images, 'c' the components for forming magenta images and 'd' the components for forming yellow images. Image forming apparatus 100 includes exposure unit 1, fixing unit 12, a sheet conveyor system S and a paper feed tray 10 and a paper output tray 15.

Charger 5 electrifies the photoreceptor drum 3 surface at a predetermined potential.

As charger 5, other than the contact roller-type charger shown in FIG. 1, a contact brush-type charger, a non-contact type discharging type charger and others may be used.

Exposure unit 1 is a laser scanning unit (LSU) including a laser emitter and reflection mirrors as shown in FIG. 1. Other than the laser scanning unit, arrays of light emitting elements such as EL (electroluminescence) and LED writing heads, may be also used as exposure unit 1. Exposure unit 1 illuminates the photoreceptor drums 3 that have been electrified, in accordance with input image data so as to form electrostatic latent images corresponding to the image data on the surfaces of photoreceptor drums 3.

Developing device 2 visualizes (develops) the electrostatic latent image formed on photoreceptor drum 3 with toner of K, C, M or Y. Arranged over developing devices 2 (2*a*, 2*b*, 2*c* and 2*d*) are toner transport mechanisms 102 (102*a*, 102*b*, 102*c* and 102*d*), toner supply devices 22 (22*a*, 22*b*, 22*c* and 22*d*) and developing vessels (developer container) 111 (111*a*, 111*b*, 111*c* and 111*d*).

Toner supply device 22 is arranged on the upper side of developing vessel 111 and stores unused toner (powdery toner). This unused toner is supplied from toner supply device 22 to developing vessel 111 by means of toner transport mechanism 102. Toner supply device 22 is constructed so as to be detachably attached to image forming apparatus 100. That is, the image forming apparatus 100 is constructed such that when, for example, the toner stored in one of toner supply devices 22 is used up in image forming, the toner supply device 22 is removed from image forming apparatus 100 and replaced with a new toner supply device 22.

Cleaner unit 4 removes and collects the toner remaining on the photoreceptor drum 3 surface after development and image transfer steps.

Arranged over photoreceptor drums 3 is an intermediate transfer belt unit 8. Intermediate transfer belt unit 8 includes intermediate transfer rollers 6 (6*a*, 6*b*, 6*c* and 6*d*), an intermediate transfer belt 7, an intermediate transfer belt drive roller 71, an intermediate transfer belt driven roller 72, an intermediate transfer belt tensioning mechanism 73 and an intermediate transfer belt cleaning unit 9.

Intermediate transfer rollers 6, intermediate transfer belt drive roller 71, intermediate transfer belt driven roller 72 and intermediate transfer belt tensioning mechanism 73 support and tension intermediate transfer belt 7 to circulatively drive intermediate transfer belt 7 in the direction of an arrow B in FIG. 1.

Intermediate transfer rollers 6 are rotatably supported at intermediate transfer roller fitting portions in intermediate transfer belt tensioning mechanism 73. Applied to each intermediate transfer roller 6 is a transfer bias for transferring the toner image from photoreceptor drum 3 to intermediate transfer belt 7.

Intermediate transfer belt 7 is arranged so as to be in contact with each photoreceptor drum 3. The toner images of different color components formed on photoreceptor drums 3 are successively transferred one over another to intermediate transfer belt 7 so as to form a full-color toner image (multicolor toner image). This intermediate transfer belt 7 is formed of an endless film of about 100 to 150 μm thick, for instance.

Transfer of the toner image from photoreceptor drum 3 to intermediate transfer belt 7 is effected by intermediate transfer roller 6 which is put in contact with the interior side of intermediate transfer belt 7. A high-voltage transfer bias (a high voltage of a polarity (+) opposite to the polarity (−) of the electrostatic charge on the toner) is applied to each intermediate transfer roller 6 in order to transfer the toner image.

Intermediate transfer roller 6 is composed of a shaft formed of metal (e.g., stainless steel) having a diameter of 8 to 10 mm and a conductive elastic material (e.g., EPDM, foamed urethane, etc.) coated on the shaft surface. Use of this conductive elastic material enables intermediate transfer roller 6 to uniformly apply high voltage to intermediate transfer belt 7. Though in the present embodiment, roller-shaped elements (intermediate transfer rollers 6) are used as the transfer electrodes, brushes etc. can also be used in their place.

The electrostatic latent image formed on each of photoreceptor drums 3 is developed as described above with the toner associated with its color component into a visual toner image. These toner images are laminated on intermediate transfer belt 7, laying one image over another. The thus formed lamination of toner images is moved by rotation of intermediate transfer belt 7 to the contact position (transfer position) between the conveyed paper and intermediate transfer belt 7, and is transferred to the paper by a transfer roller 11 arranged at that position. In this case, intermediate transfer belt 7 and transfer roller 11 are pressed against each other forming a predetermined nip while a voltage for transferring the toner image to the paper is applied to transfer roller 11. This voltage is a high voltage of a polarity (+) opposite to the polarity (−) of the electrostatic charge on the toner.

In order to keep the aforementioned nip constant, either transfer roller 11 or intermediate transfer belt drive roller 71 is formed of a hard material such as metal or the like while the other is formed of a soft material such as an elastic roller or the like (elastic rubber roller, foamed resin roller etc.).

Of the toner adhering to intermediate transfer belt 7 as the belt comes into contact with photoreceptor drums 3, the toner which has not been transferred from intermediate transfer belt 7 to the paper during transfer of the toner image and remains on intermediate transfer belt 7 would cause contamination of color toners at the next operation, hence is removed and collected by intermediate transfer belt cleaning unit 9.

Intermediate transfer belt cleaning unit 9 includes a cleaning blade (cleaning member) that is put in contact with intermediate transfer belt 7. Intermediate transfer belt 7 is supported from its interior side by intermediate transfer belt driven roller 72, at the area where the cleaning blade is put in contact with intermediate transfer belt 7.

Paper feed tray 10 is to stack sheets (e.g., recording paper) to be used for image forming and is disposed under the image forming portion and exposure unit 1. On the other hand, paper output tray 15 disposed at the top of image forming apparatus 100 stacks printed sheets with the printed face down.

Image forming apparatus 100 also includes sheet conveyor system S for guiding sheets from paper feed tray 10 and from a manual feed tray 20 to paper output tray 15 by way of the transfer portion and fixing unit 12. Here, the transfer portion is located between intermediate transfer belt drive roller 71 and transfer roller 11.

Arranged along sheet conveyor system S are pickup rollers 16 (16*a*, 16*b*), a registration roller 14, the transfer portion, fixing unit 12 and feed rollers 25 (25*a* to 25*h*) and the like.

Feed rollers 25 are a plurality of small-diametric rollers arranged along sheet conveyor system S to promote and assist sheet conveyance. Pickup roller 16*a* is a roller disposed at the end of paper feed tray 10 for picking up and supplying the paper one sheet at a time from paper feed tray 10 to sheet conveyor system S. Pickup roller 16*b* is a roller disposed at the vicinity of manual feed tray 20 for picking up and supplying the paper, one sheet at a time, from manual feed tray 20 to sheet conveyor system S. Registration roller 14 temporarily suspends the sheet being conveyed on sheet conveyor system S and delivers the sheet to the transfer portion at such timing that the front end of the sheet meets the front end of the image area on intermediate transfer belt 7.

Fixing unit 12 includes a heat roller 81, a pressing roller 82 and the like. These heat roller 81 and pressing roller 82 rotate while nipping the sheet therebetween. Heat roller 81 is controlled by a control unit 32 (FIG. 8) so as to keep a predetermined fixing temperature. This control unit 32 controls the temperature of heat roller 81 based on the detection signal from a temperature detector (not shown).

Heat roller 81 fuses, mixes and presses the lamination of color toner images transferred on the sheet by thermally pressing the sheet with pressing roller 82 so as to thermally fix the toner onto the sheet. The sheet with a multi-color toner image (each color toner image) fixed thereon is conveyed by plural feed rollers 25 to the inversion paper discharge path of sheet conveyor system S and discharged onto paper output tray 15 in an inverted position (with, the multi-color toner image placed facedown).

Next, the operation of sheet conveyance by sheet conveyor system S will be described.

As shown in FIG. 1, image forming apparatus 100 has paper feed tray 10 that stacks sheets beforehand and manual feed tray 20 that is used when a few pages are printed out. Each tray is provided with pickup roller 16 (16*a*, 16*b*) so that these pickup rollers 16 supply the paper one sheet at a time to sheet conveyor system S.

In the case of one-sided printing, the sheet conveyed from paper feed tray 10 is conveyed by feed roller 25*a* in sheet conveyor system S to registration roller 14 and delivered to the transfer portion (the contact position between transfer roller 11 and intermediate transfer belt 7) by registration roller 14 at such timing that the front end of the sheet meets the front end of the image area including a lamination of toner images on intermediate transfer belt 7. At the transfer portion, the toner image is transferred onto the sheet. Then, this toner image is fixed onto the sheet by fixing unit 12. Thereafter, the sheet passes through feed roller 25*b* to be discharged by paper output roller 25*c* onto paper output tray 15.

Also, the sheet conveyed from manual feed tray 20 is conveyed by plural feed rollers 25 (25*f*, 25*e* and 25*d*) to registration roller 14. From this point, the sheet is conveyed and discharged to paper output tray 15 through the same path as that of the sheet fed from the aforementioned paper feed tray 10.

On the other hand, in the case of dual-sided printing, the sheet that has been printed on the first side and passed through fixing unit 12 as described above is nipped at its rear end by paper discharge roller 25*c*. Then the paper discharge roller 25*c* is rotated in reverse so that the sheet is guided to feed rollers 25*g* and 25*h*, and conveyed again through registration roller 14 so that the sheet is printed on its rear side and then discharged to paper output tray 15.

Next, the configuration of toner supply device 22 will be specifically described.

Figure 2:
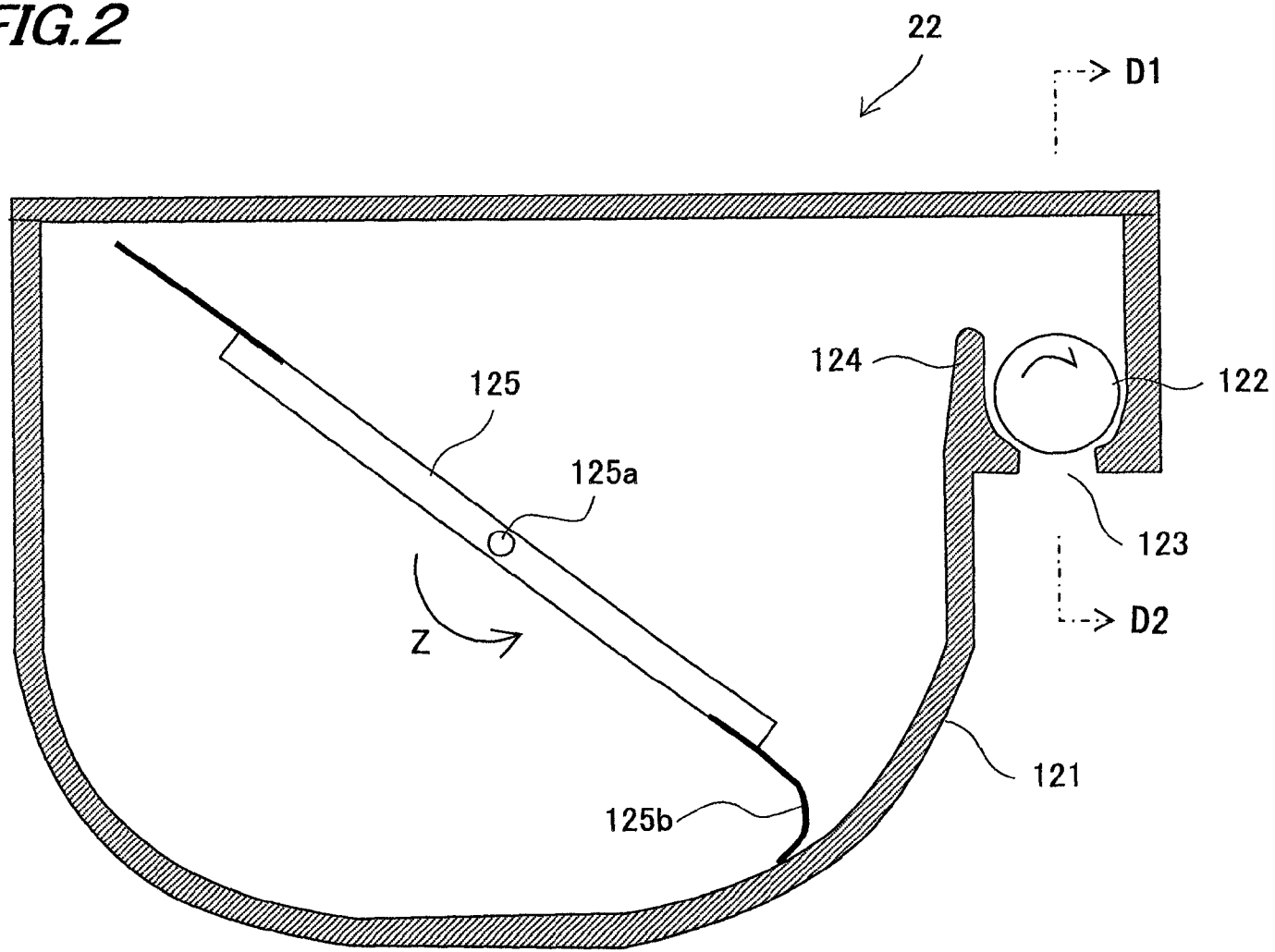
FIG. 2 is a sectional view showing a schematic configuration of a toner supply device that constitutes the image forming apparatus.
Figure 3:
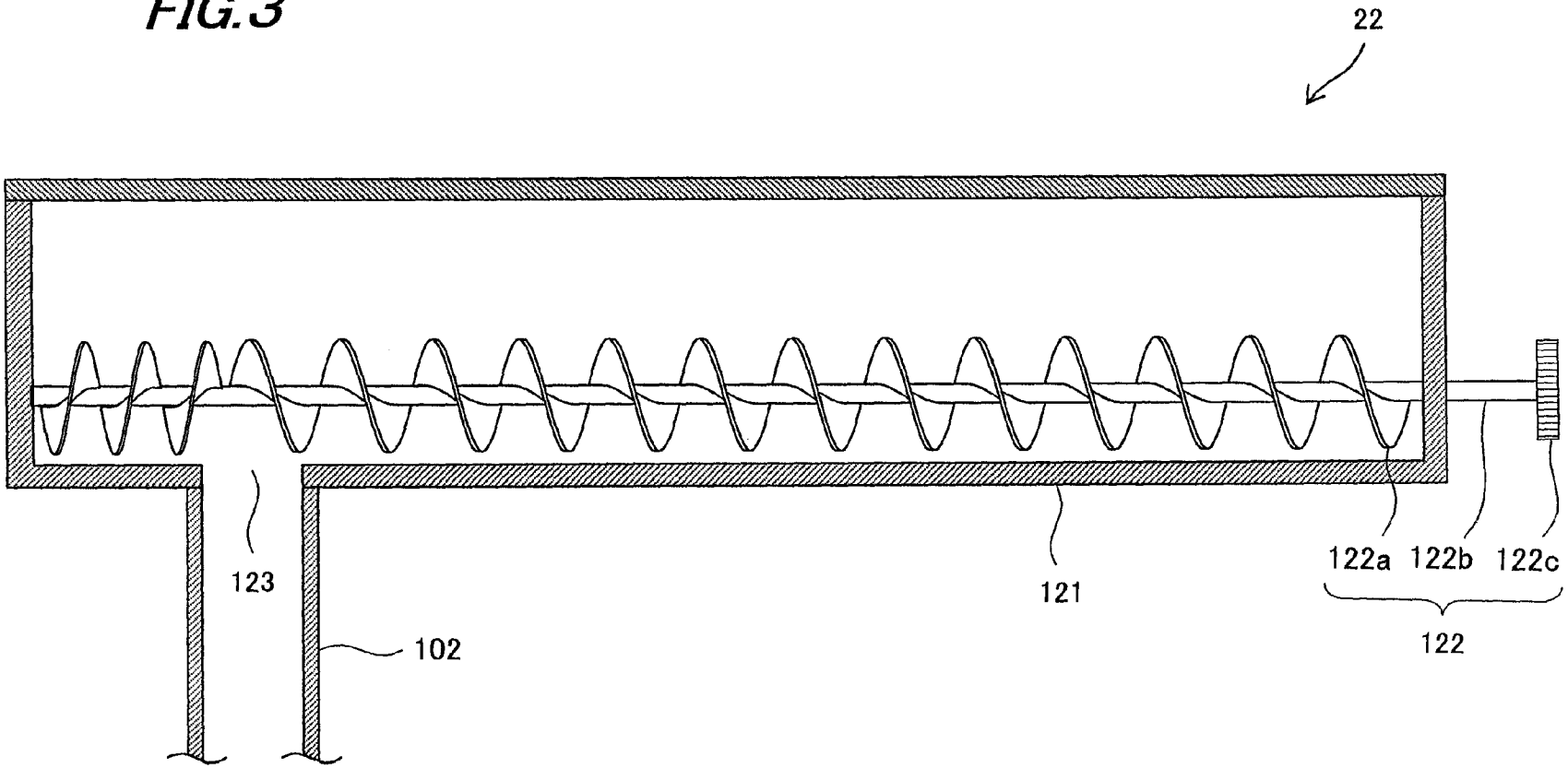
FIG. 3 is a sectional view cut along a plane D1-D2 in FIG. 2.

FIG. 2 is a sectional view showing a schematic configuration of the toner supply device that constitutes the image forming apparatus according to the present embodiment. FIG. 3 is a sectional view cut along a plane D1-D2 in FIG. 2.

As shown in FIGS. 2 and 3, toner supply device 22 includes a toner storing container 121, a toner agitator 125, a toner discharger 122 and a toner discharge port 123. Toner supply device 22 is arranged on the upper side of developing vessel 111 (FIG. 1) and stores unused toner (powdery toner). The toner in toner supply device 22 is supplied from toner discharge port 123 to developing vessel 111 (FIG. 1) by means of toner transport mechanism 102 (FIG. 1) as toner discharger (discharging screw) 122 is rotated.

Toner storing container 121 is a container part, having a substantially semicylindrical configuration with a hollow interior, and rotationally supporting toner agitator 125 and toner discharger 122 to store toner. As shown in FIG. 3, toner discharge port 123 is a substantially rectangular opening disposed under toner discharger 122 and positioned near to the center with respect to the direction of the axis (the axial direction: longitudinal direction) of toner discharger 122 so as to oppose toner transport mechanism 102.

Toner agitator 125 is a plate-like part that rotates about a rotary axis 125*a* as shown in FIG. 2 and draws up and conveys the toner stored inside toner storing container 121 toward toner discharger 122 whilst agitating the toner. Toner agitator 125 has toner scooping parts 125*b* at both the ends thereof. Toner scooping part 125*b* is formed of a polyethylene terephthalate (PET) sheet having flexibility and is attached to either end of toner agitator 125.

Figure 8:
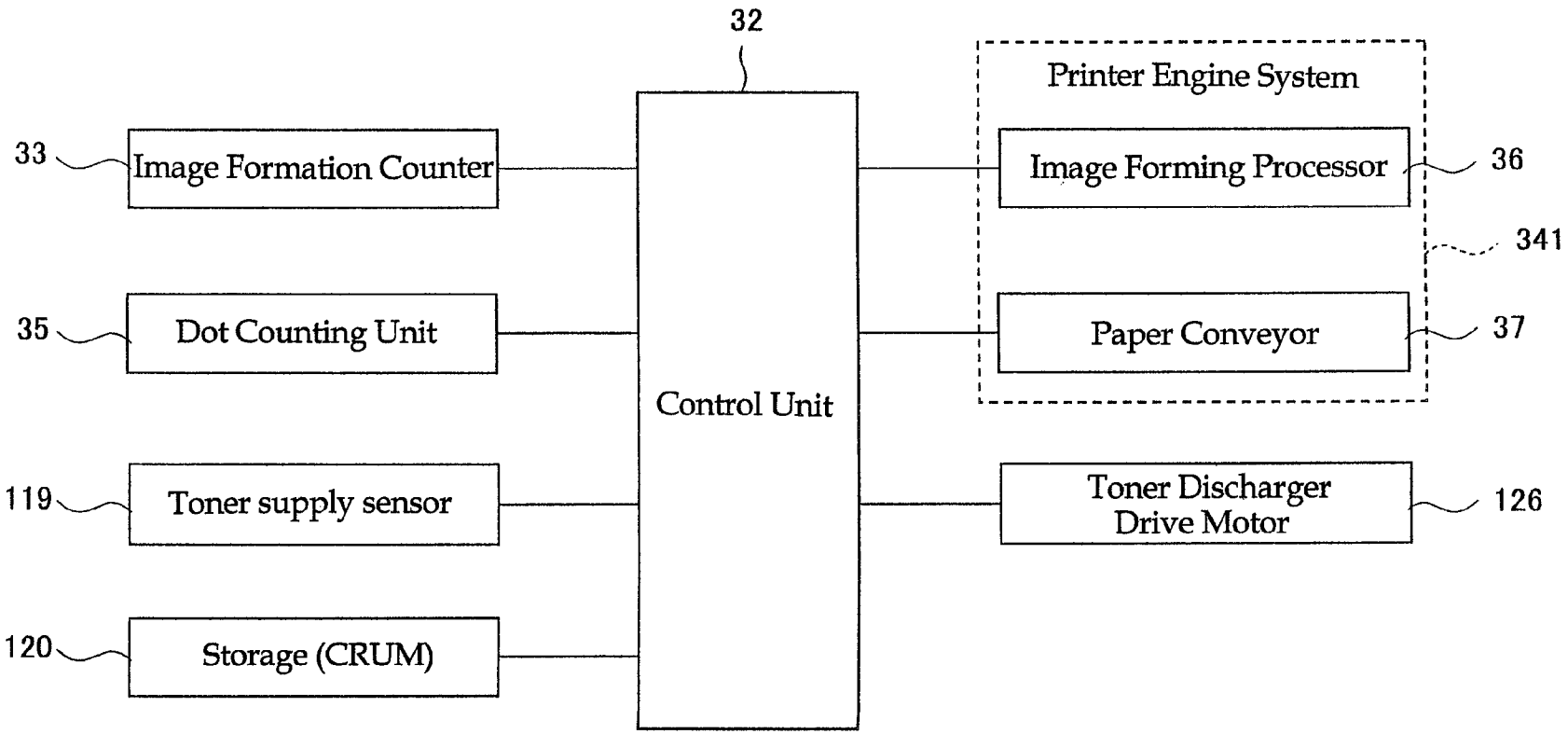

Toner discharger 122 dispenses the toner in toner storing container 121 from toner discharge port 123 to developing vessel 111, and is formed of a screw auger having a toner conveyor blade 122*a* and a toner discharger rotary shaft 122*b* and a toner discharger rotating gear 122*c*, as shown in FIG. 3. Toner discharger 122 is rotationally driven by a toner discharger drive motor 126 (FIG. 8). As to the helix direction of the screw auger, toner conveyor blade 122*a* is designed so that toner can be conveyed from both ends of toner discharger 122 toward toner discharge port 123 with respect to the axial direction of toner discharger 122.

Provided between toner discharger 122 and toner agitator 125 is a toner discharger partitioning wall 124. This wall makes it possible to keep and hold the toner scooped by toner agitator 125 in an appropriate amount around toner discharger 122.

As shown in FIG. 2, when toner agitator 125 rotates in the direction of arrow Z to agitate and scoop up the toner toward toner agitator 122, toner scooping parts 125*b* rotate as they are deforming and sliding over the interior wall of toner storing container 121 due to the flexibility thereof, to thereby supply the toner toward the toner discharger 122 side. Then, toner discharger 122 turns so as to lead the supplied toner to toner discharge port 123.

Next, the characteristic configuration of image forming apparatus 100 will be described with reference to the drawings.

Figure 4:
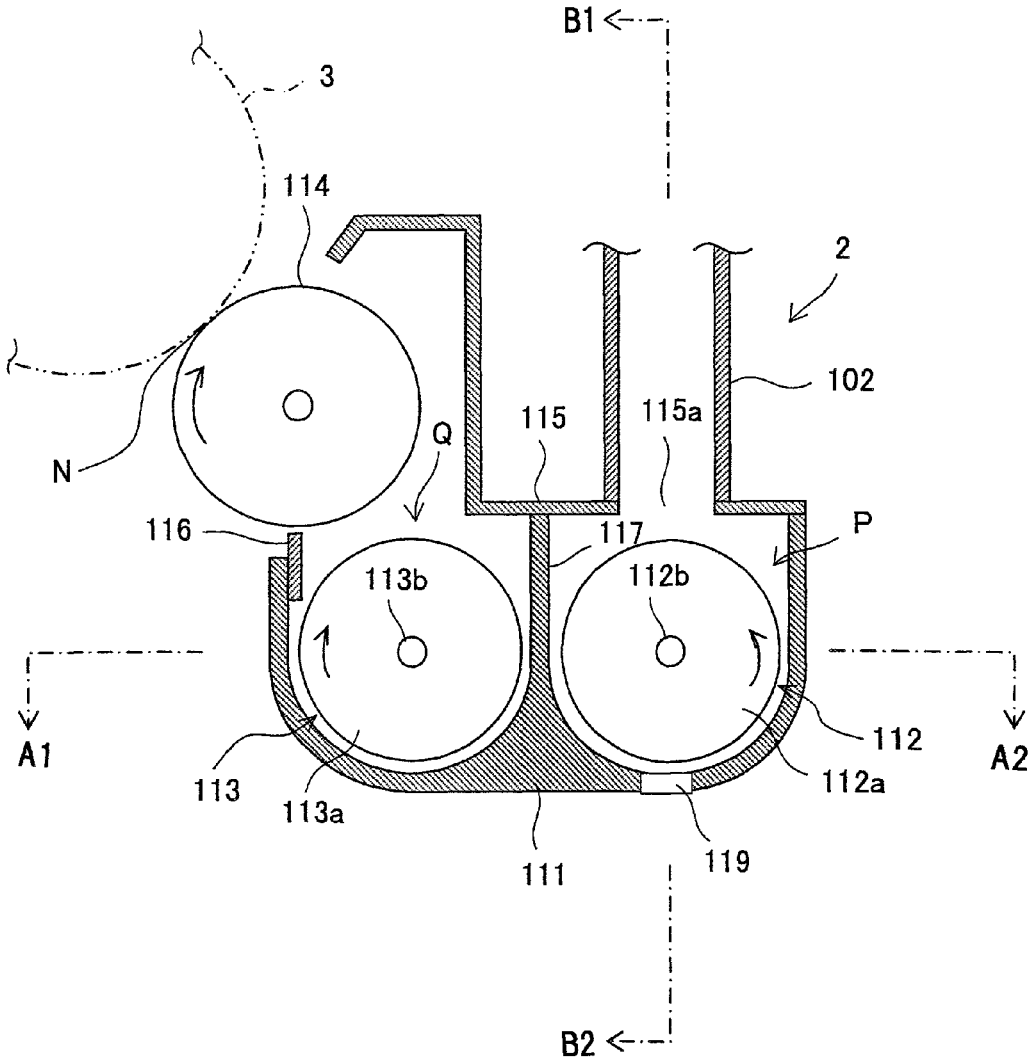
FIG. 4 is a sectional view showing a configuration of a developing device that constitutes the image forming apparatus.
Figure 5:
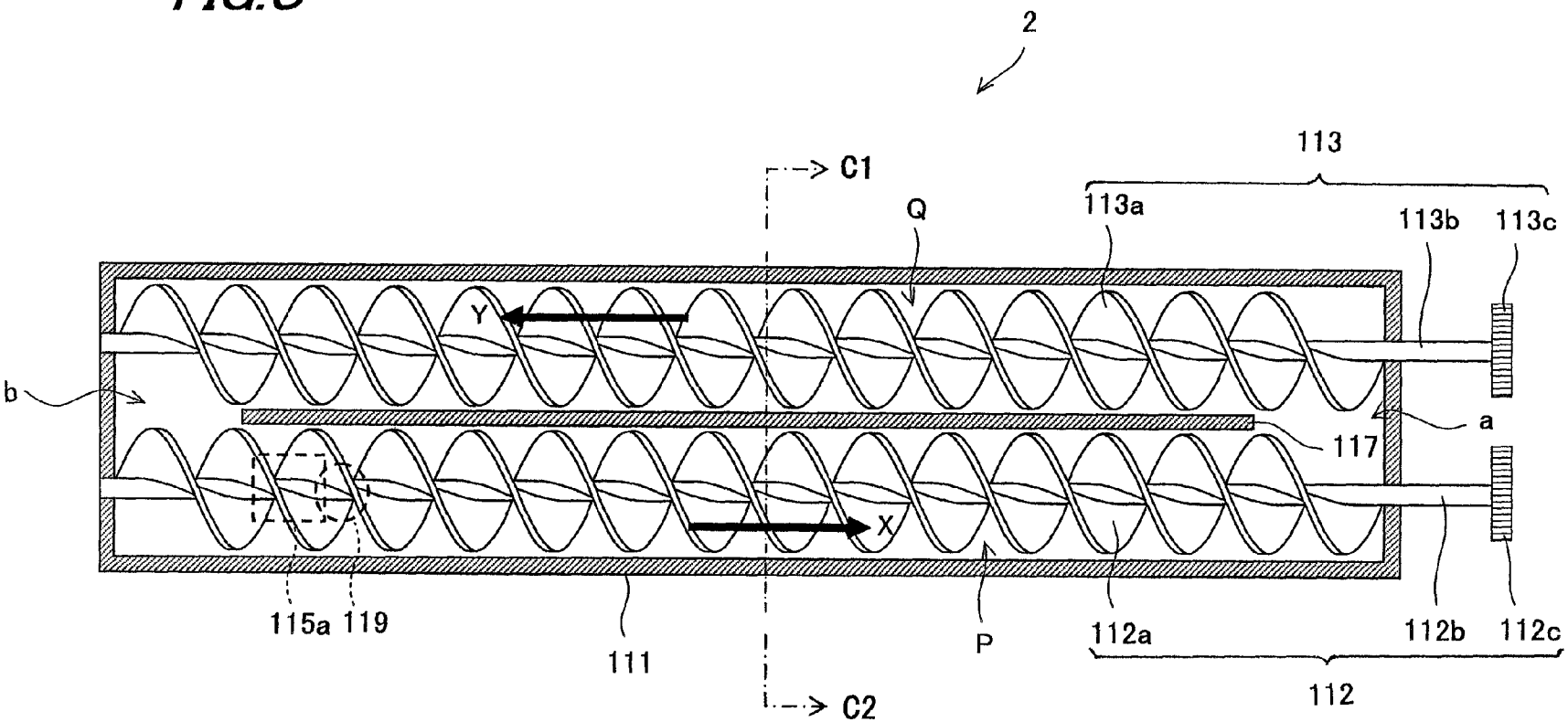
FIG. 5 is a sectional view cut along a plane A1-A2 in FIG. 4.
Figure 6:
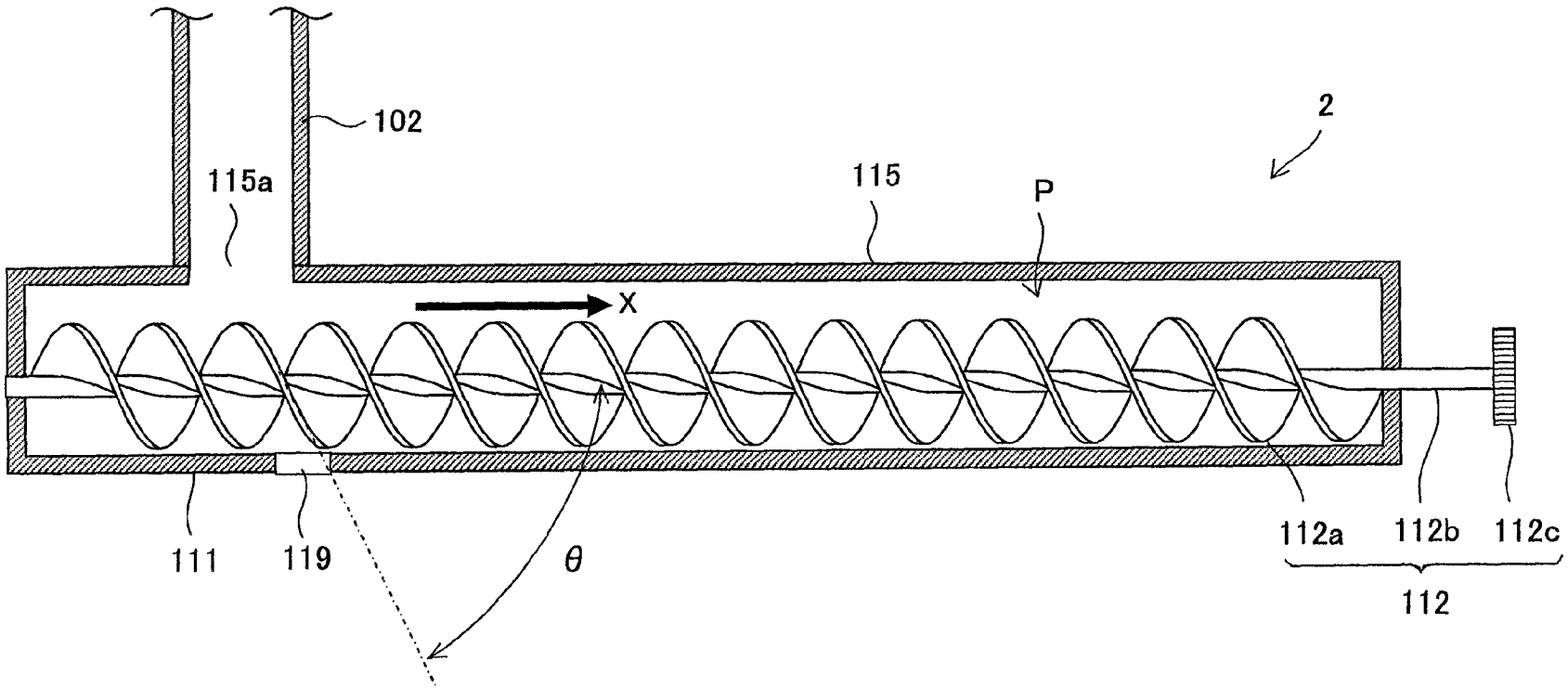
FIG. 6 is a sectional view cut along a plane B1-B2 in FIG. 4.
Figure 7:
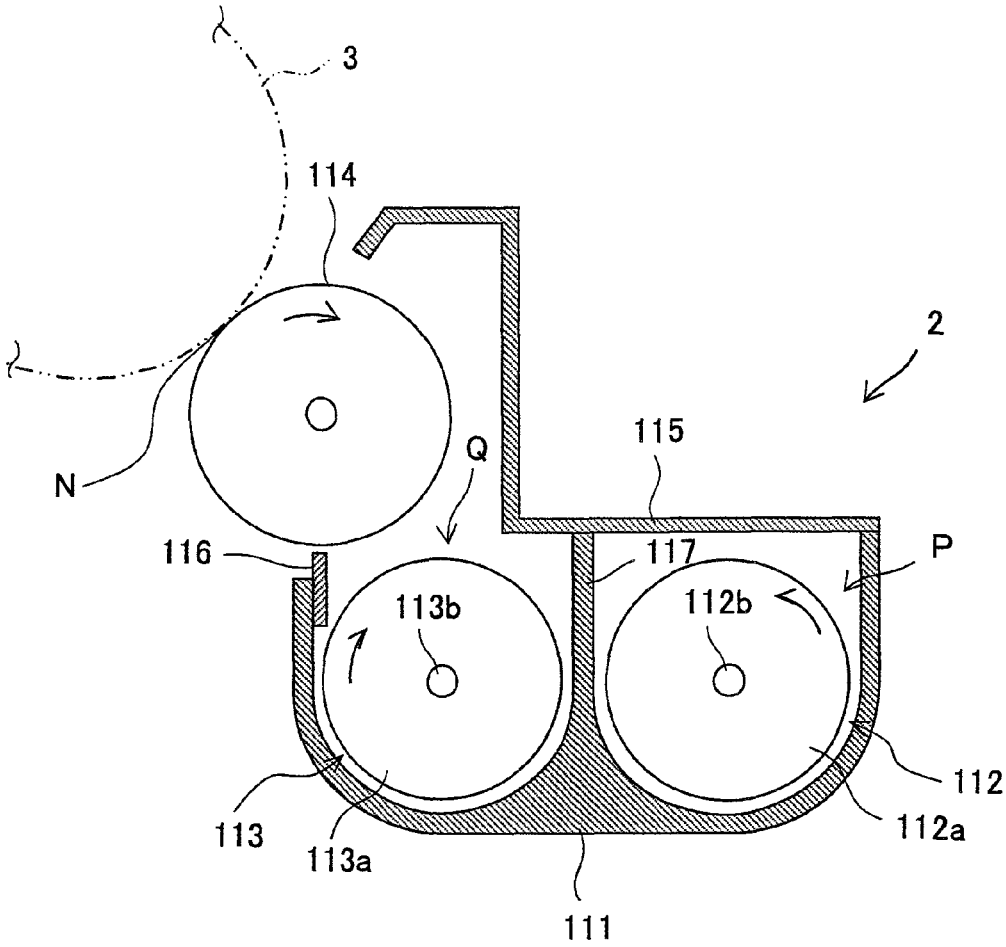
FIG. 7 is a sectional view cut along a plane C1-C2 in FIG. 5; and, FIG. 8 is a block diagram showing a configuration of a control system in the image forming apparatus.

FIG. 4 is a sectional view showing the configuration of developing device 2 according to the present embodiment, FIG. 5 is a sectional view cut along a plane A1-A2 in FIG. 4, FIG. 6 is a sectional view cut along a plane B1-B2 in FIG. 4, FIG. 7 is a sectional view cut along a plane C1-C2 in FIG. 5, and FIG. 8 is a block diagram showing a configuration of a control system in the image forming apparatus.

Image forming apparatus 100 of the present embodiment includes: as shown in FIGS. 1 and 4, developing device 2 having a toner supply port 115*a* through which supplied toner is input into developing vessel (developer container) 111 for storing the developer and a toner supply sensor 119 (FIG. 4) disposed near toner supply port 115*a* to detect the amount of toner supply; toner supply device 22 for supplying toner to developing device 2; a toner supply controller for controlling toner supply from toner supply device 22 to developing device 2 based on predetermined conditions; and a toner empty determiner that determines that toner in toner supply device 22 is used up when the amount of supplied toner becomes lower than a threshold.

In the present embodiment, control unit 32 shown in FIG. 8 is constructed so as to provide the functions of the toner supply controller and the toner empty determiner.

With this arrangement, toner supply device 22 includes, as shown in FIG. 8, a storage 120 for storing toner supply information detected at every toner supply operation by toner supply sensor 119, and control unit 32 functioning as the toner supply controller corrects the amount of toner supply from toner supply device 22 to developing device 2, based on the toner supply information stored in storage 120.

To begin with, developing device 2 will be described with reference to the drawings.

As shown in FIG. 4, developing device 2 has a developing roller (developer bearer) 114 arranged inside developing vessel 111 so as to oppose photoreceptor drum 3 and supplies toner from developing roller 114 to the photoreceptor drum 3 surface to visualize (develop) the electrostatic latent image formed on the surface of photoreceptor drum 3.

As shown in FIGS. 4 to 7, developing device 2, other than developing roller 114, further includes developing vessel 111, a developing vessel cover 115, toner supply port 115*a*, a doctor blade 116, a first conveying member 112, a second conveying member 113, a partitioning plate (partitioning wall) 117 and toner supply sensor 119.

Developing vessel 111 is a vessel for holding a dual-component developer that contains a toner and a carrier (which will be simply referred to hereinbelow as "developer"). Developing vessel 111 includes developing roller 114, first conveying member 112, second conveying member 113 and the like. Here, the carrier of the present embodiment is a magnetic carrier presenting magnetism.

Arranged on the top of developing vessel 111 is removable developing vessel cover 115, as shown in FIGS. 4 and 6. This developing vessel cover 115 is formed with toner supply port 115*a* for supplying unused toner into developing vessel 111.

Arranged in developing vessel 111 is partitioning plate 117 between first conveying member 112 and second conveying member 113. Partitioning plate 117 is extended parallel to the axial direction (the direction in which each rotary axis is laid) of first and second conveying members 112 and 113. The interior of developing vessel 111 is divided by partitioning plate 117 into two sections, namely, a first conveying passage P with first conveying member 112 and a second conveying passage Q with second conveying member 113.

Partitioning plate 117 is arranged so that its ends, with respect to the axial direction of first and second conveying members 112 and 113, are spaced from respective interior wall surfaces of developing vessel 111. Hereby, developing vessel 111 has communicating paths that communicate between first conveying passage P and second conveying passage Q at around both axial ends of first and second conveying members 112 and 113. In the following description, as shown in FIG. 5, the communicating path formed on the downstream side with respect to the direction of arrow X is named first communicating path a and the communicating path formed on the downstream side with respect to the direction of arrow Y is named second communicating path b.

First conveying member 112 and second conveying member 113 are arranged and rotated in opposite directions so that their axes are parallel to each other with their peripheral sides opposing each other across partitioning plate 117. In this arrangement, as shown in FIG. 5, first conveying member 112 conveys the dual-component developer in the direction of arrow X while second conveying member 113 conveys the developer in the direction of arrow Y, which is the opposite to the direction of arrow X.

As shown in FIG. 5, first conveying member 112 is composed of a screw auger formed of a first helical conveying blade 112*a* and a first rotary shaft 112*b*, and a gear 112*c*. As shown in FIG. 5, second conveying member 113 is composed of a screw auger formed of a second helical conveying blade 113*a* and a second rotary shaft 113*b*, and a gear 113*c*. First and second conveying members 112 and 113 are rotationally driven by a drive means (not shown) such as a motor etc., to agitate and convey the developer.

As shown in the sectional view of FIG. 6, first conveying member 112 is formed so that the angle formed between first rotary shaft 112*b* and the peripheral, edge of first conveying blade 112*a*, or the inclined angle θ of the helical blade, falls within the range of 30 degrees to 60 degrees. Second conveying member 113 also has the same configuration as that of first conveying member 112.

Specifically, when the inclined angle θ of the helical blade of first conveying member 112 is equal to or greater than 30 degrees and equal to smaller than 60 degrees, the force of first conveying member 112 for agitating the developer in the rotational direction is so strong that the so-called "floating toner" phenomenon, the phenomenon of the supplied toner being conveyed floating over the developer, is unlikely to occur. Accordingly, it is possible for toner supply sensor 119 to detect the toner concentration of the developer with precision.

On the other hand, when the inclined angle θ of the helical blade is less than 30 degrees, the speed of the developer being conveyed by first conveying member 112 is low so that the developer is abraded quickly. When the inclined angle θ of the helical blade exceeds 60 degrees, the speed of the developer being conveyed by first conveying member 112 becomes too high so that the floating toner is prone to occur.

Developing roller 114 (FIG. 4) is a rotating magnet roller which is rotationally driven about its axis by an unillustrated driver, draws up and carries the developer in developing vessel 111 on the surface thereof and supplies toner included in the developer supported on the surface thereof to photoreceptor drum 3.

The developer conveyed by developing roller 114 comes into contact with photoreceptor drum 3 in the area where the distance between developing roller 114 and photoreceptor drum 3 becomes minimum. This contact area forms a developing nip portion N. As a developing bias is applied to developing roller 114 from an unillustrated power source that is connected to developing roller 114, toner is supplied in developing nip portion N, from the developer on the developing roller 114 surface to the electrostatic latent image on the photoreceptor drum 3 surface.

Arranged close to the surface of developing roller 114 is a doctor blade (layer thickness limiting blade) 116.

Doctor blade 116 is a rectangular plate-shaped member that is extended parallel to the axial direction of developing roller 114, disposed vertically below developing roller 114 and supported along its longitudinal side by developing vessel 111 so that its opposite longitudinal side is positioned a gap apart from the developing roller 114 surface. This doctor blade 116 may be made of stainless steel, or may be formed of aluminum, synthetic resin or the like.

Concerning the attachment of toner supply sensor 119, with regard to the horizontal direction (developer conveying direction), the sensor is attached at a position near and on the downstream side of toner supply port 115*a* with respect to the developer conveying direction (the direction of arrow X) while with regard to the vertical direction, the sensor is attached on the base of developing vessel 111 vertically below first conveying member 112, as shown in FIGS. 4 to 6. That is, toner supply sensor 119 is attached to the base of first conveying passage P with its sensor face exposed to the interior of developing vessel 111.

Toner supply sensor 119 is electrically connected to control unit 32 (see FIG. 8). Toner supply sensor 119 may use general-purpose detection sensors. Examples include transmitted light detecting sensors, reflected light detecting sensors, magnetic permeability detecting sensors, etc. Of these, magnetic permeability detecting sensors are preferable.

The magnetic permeability detecting sensor is connected to an unillustrated power supply. The power supply applies to the magnetic permeability detecting sensor the drive voltage for driving the magnetic permeability detecting sensor and the control voltage for outputting the detected result of toner concentration to control unit 32. Application of voltage to the magnetic permeability detecting sensor from the power supply is controlled by control unit 32. The magnetic permeability detecting sensor is a sensor of a type that receives application of a control voltage and outputs the detected result of toner concentration as an output voltage. Since, basically, the sensor is sensitive in the middle range of the output voltage, the applied control voltage is adjusted so as to produce output voltage around that range. Magnetic permeability detecting sensors of this kind are found on the market, examples including TS-L, TS-A and TS-K (all of these are trade names and products of TDK Corporation).

Now, conveyance of the developer in the developing vessel of developing device 2 will be described.

As shown in FIGS. 3 and 4, the toner stored in toner supply device 22 is transported into developing vessel 111 by way of toner transport mechanism 102 and toner supply port 115*a*, whereby toner is supplied to developing vessel 111.

In developing vessel 111, first conveying member 112 and second conveying member 113 are rotationally driven by a drive means (not shown) such as a motor etc., to convey the developer. More specifically, in first conveying passage P, the developer is agitated and conveyed in the direction of arrow X (FIG. 5) by first conveying member 112 to reach first communicating path a. The developer reaching first communicating path a is conveyed through first communicating path a to second conveying passage Q.

On the other hand, in second conveying passage Q, the developer is agitated and conveyed in the direction of arrow Y (FIG. 5) by second conveying member 113 to reach second communicating path b. Then, the developer reaching second communicating path b is conveyed through second communicating path b to first conveying passage P.

That is, first conveying member 112 and second conveying member 113 agitate the developer while conveying the developer in opposite directions.

In this way, the developer is circulatively moving in developing vessel 111 along first conveying passage P, first communicating path a, second conveying passage Q and second communicating path b, in this mentioning order. In this arrangement, the developer is carried and drawn up by the surface of rotating developing roller 114 while being conveyed in second conveying passage Q, and the toner in the scooped developer is continuously consumed as moving toward photoreceptor drum 3.

In order to compensate for this consumption of toner, unused toner is supplied from toner supply port 115*a* into first conveying passage P. The supplied toner is agitated and mixed in first conveying passage P with the previously existing developer.

Next, the toner supply controller and the toner empty determiner in image forming apparatus 100 will be specifically described.

In the present embodiment, control unit 32 shown in FIG. 8 constitutes the toner supply controller and toner empty determiner.

The toner supply control method may use a general control method. For example, control using a toner concentration detecting sensor, control based on patch image density, control based on dot counting and the like can be mentioned. Of these, control based on dot counting is preferable. The toner supply control method in the present embodiment will be described based on the control using dot counting.

As shown in FIG. 8, image forming apparatus 100 includes a dot counting unit (dot counter) 35 for counting dots of data for image data to be transmitted to exposure unit 1.

Control unit 32 directs toner supply device 22 to supply toner to developing device 2 in accordance with the counted dots of data from dot counting unit 35.

Further, as the method for determining toner empty, control unit 32 determines that no toner has been supplied from toner supply device 22 to developing device 2, or that no toner remains in toner supply device 22 (toner empty) if the amount of toner supply detected by toner supply sensor 119 is lower than the threshold even after toner supply to developing device 2 was instructed to toner supply device 22.

Now, the configuration of the control system of image forming apparatus 100 will be described in detail based on a block diagram.

As shown in FIG. 8, image forming apparatus 100 includes an image formation counter 33 for counting the total number of image forming operations, a dot counting unit 35 for detecting the total count of pixels of an image formed on photoreceptor drum 3, toner supply sensor 119 for detecting the magnetic permeability of the developer near the toner supply port 115*a*, a printer engine system 341 including an image forming processor 36 and a paper conveyor 37, a toner discharger drive motor 126 for driving toner discharger 122 (FIG. 2) and control unit 32 for controlling these.

In image forming apparatus 100, toner supply control is mainly executed by dot counting unit 35, control unit 32, toner discharger drive motor 126 and storage 120.

Dot counting unit 35 is to detect the total of the number of pixels of an image (electrostatic latent image) formed on photoreceptor drum 3 corresponding to the printed image, and determines the sum of the count of the pixels of the images to be printed as the dot count value and the total count of the images that have been printed heretofore. The dot count value is recorded into storage 120 by control unit 32. From the sum (dot count value) of the number of pixels detected at dot counting unit 35, the amount of toner to be consumed for image forming can be estimated.

Control unit 32 determines the amount of toner to be consumed for the current image forming, based on the dot count value, and directs toner discharger drive motor 126 to rotate and drive toner discharger 122 of toner supply device 22 in accordance with the determined amount of toner.

In this way, toner corresponding to the amount of toner having been consumed from developing device 2 (developing vessel 111) is supplied from toner supply device 22 into developing device 2 (developing vessel 111).

In image forming apparatus 100, the toner empty determination control is mainly executed by toner supply sensor 119, control unit 32 and storage 120 shown in FIG. 8.

In the present embodiment, the amount of toner supplied into developing vessel 111 is monitored by toner supply sensor 119, and if the amount of toner supply detected by toner supply sensor 119 is lower than the threshold even after toner supply instruction was given from control unit 32 to toner supply device 22, the control unit 32 determines the occurrence of toner empty.

Next, toner supply to developing device 2 in image forming apparatus 100 of the present embodiment will be described.

Toner supply is performed from toner supply device 22 to developing device 2 by the toner supply controller (control unit 32) directing toner supply device 22 to supply toner to developing device 2 when the toner concentration of the developer in developing vessel 111 of developing device 2 has lowered and becomes lower than a predetermined level.

Toner supply into developing vessel 111 is detected by toner supply sensor 119.

Since toner supply sensor 119 is disposed on the base in first conveying passage P under toner supply port 115*a*, if toner is added to the developer from toner supply port 115*a*, change of the magnetic permeability of the developer can be detected at once. That is, it is possible to immediately confirm whether or not toner supply from toner supply device 22 is performed.

Accordingly, when no change of the magnetic permeability of the developer is detected by toner supply sensor 119 even after toner supply instruction was transmitted from toner supply controller (control unit 32) to toner supply device 22, it can be determined that no toner has been supplied from toner supply device 22. That is, it is possible for the empty determiner (control unit 32) to precisely determine that the toner in toner supply device 22 is used up (toner empty).

Further, in the present embodiment, toner supply device 22 includes storage 120 for storing the toner supply information detected at every toner supply operation by toner supply sensor 119.

As storage 120, a nonvolatile memory called CRUM (Customer Replaceable Unit Memory) mounted on toner supply device 22 is used.

Toner supply controller (control unit 32) controls the amount of toner to be supplied from toner supply device 22 to developing device 2 based on the toner supply information on the amount of toner supplied from toner supply device 22, stored in storage 120.

The toner supply information includes the amount of toner (that is, the amount of toner supplied from toner supply device 22) detected by toner supply sensor 119 every time toner discharger drive motor 126 is driven.

However, detection on the amount of toner supply for a single toner supply operation naturally involves error and variation. To deal with this, the average (moving average) of a multiple number of sampled (detected) amounts of toner supply, detected by the latest multiple toner supply operations is calculated and recorded into storage 120 as the toner supply information.

Accordingly, in the present embodiment, in order to calculate the moving average, multiple detected values of the amount of toner supply, detected for the latest multiple (two or greater number of) toner supply operations are stored in storage 120 as the toner supply information.

Determination of the amount of toner supply based on the moving average enables more precise toner supply control.

In the present embodiment, control unit 32 records the detected values of toner supply for the latest 20 times of toner supply operation, detected by toner supply sensor 119 into storage 120 as the toner supply information and also calculates the moving average of the detected values at the 20 times of toner supply and records the moving average into storage 120.

Now, correction to the amount of toner supply by toner supply device 22 based on the toner supply information will be described by taking a specific example.

Suppose that, for example, the pre-set amount of toner to be supplied from toner supply device 22 mounted in image forming apparatus 100 is 0.2 g for each drive of toner discharger drive motor 126, and the actual amount of toner supply (e.g., the moving average) detected at the time of toner supplying fluctuates between 0.16 to 0.25 g, depending on individual toner supply devices.

In this case, based on the moving average of the latest 20 times of toner supply obtained as the toner supply information, the amount of drive (the frequency of toner supply) of toner discharger drive motor 126 is corrected by multiplying by 1.25 to 0.80, whereby it is possible to compensate for surplus or shortage of the actual amount of toner supplied.

The rotational rate (drive speed) or rotational time (drive time) is used as the amount of drive of toner discharger drive motor 126.

That is, correction is made such that the amount of drive (the amount of supply) is increased when the moving average of toner supplies is lower than 0.20 g, whereas the amount of drive (the amount of supply) is decreased when the moving average of toner supplies is greater than 0.20 g, whereby it is possible to perform optimal toner supply.

In the present embodiment, image forming apparatus 100 is configured so as to store the amount of toner supply (the detected value) detected by toner supply sensor 119 and its moving average, appropriately, into storage 120 provided in toner supply device 22. With this configuration, even if toner supply device 22 is set to another image forming apparatus, it is possible for the new image forming apparatus to promptly make appropriate correction to the amount of toner supply of the toner supply device 22, in accordance with the toner supply information stored in storage 120 of the set toner supply device 22. As a result, it is possible to prevent change in image quality due to variation in toner concentration before and after replacement of toner supply device 22.

According to the present embodiment, the configuration described as above makes it possible for the toner supply controller in image forming apparatus 100 to control, or increase or decrease the amount in which toner is supplied depending on each individual toner supply device 22, in accordance with the toner supply information (the moving average) detected by toner supply sensor 119 after each of toner supply operation. As a result, it becomes possible to perform optimal toner supply from toner supply device 22 to developing device 2, whereby it is possible to constantly keep the stable amount of toner supply and hence prevent change in image quality due to variation of toner concentration.

Further, since in the present embodiment, the toner supply information detected from toner supply sensor 119 every time toner supply operation is performed is adapted to be stored into storage 120 provided in toner supply device 22, even if the toner supply device 22 is replaced by another one or in other cases, toner supply control can be done based on the toner supply information stored in storage 120 provided in the toner supply device that is set in place. Accordingly, it is possible to compensate for the difference in the amount of toner supply due to variation of individual toner supply devices and due to the remaining amount of toner and obtain a stable amount of toner supply, thus realizing optimal toner supply.

Further, according to the present embodiment, in the image forming apparatus 100, since toner supply sensor 119 is arranged at a position near toner supply port 115*a* inside developing vessel 111 of developing device 2 and attached on the base of first conveying passage P under the toner supply port 115*a*, it is possible to quickly and precisely detect the amount of supplied toner falling when toner is supplied from toner supply device 22.

Accordingly, even in the case where the toner concentration of the developer inside developing device 2 lowered than the predetermined level and toner supply instruction was transmitted from the toner supply controller to toner supply device 22, if the amount of toner supply detected by toner supply sensor 119 is lower than the threshold, the empty determiner can promptly conclude that the toner inside toner supply device 22 is used up (toner empty). As a result, it is possible to inhibit occurrence of carrier adhesion to photoreceptor drum 3 due to reduction in toner concentration when a toner image is formed on photoreceptor drum 3.

Further, according to the present embodiment, since first conveying member 112 is constructed so that the inclined angle θ of the helical blade falls within the range from 30 degrees to 60 degrees, the force for agitating the developer in the rotational direction of first conveying member 112 is so strong that the so-called "floating toner" phenomenon, the phenomenon of the added toner being conveyed floating over the developer, is unlikely to occur. As a result, it is possible for toner supply sensor 119 to detect the amount of toner supply with precision even right after toner supply.

Though the above embodiment was described taking an example in which the image forming apparatus of the present invention is applied to image forming apparatus 100 shown in FIG. 1, as long as it is an image forming apparatus in which the toner concentration of the developer in the developing device is controlled by supplying toner from a toner supply device, the invention can be developed to any other image forming apparatus and the like, not limited to the image forming apparatus and copier described above.

Having described heretofore, the present invention is not limited to the above embodiment, various changes can be made within the scope of the appended claims. That is, any embodied mode obtained by combination of technical means modified as appropriate without departing from the spirit and scope of the present invention should be included in the technical art of the present invention.

What is claimed is:

1. An image forming apparatus comprising:

a developing device;

a toner supply device that is detachably mounted to the image forming apparatus and supplies toner to the developing device;

a toner supply controller that controls the toner supply from the toner supply device to the developing device based on predetermined conditions;

a toner empty determiner that determines that no toner is left in the toner supply device when the amount of toner supplied from the toner supply device to the developing device is lower than a threshold, characterized in that the developing device comprises:

a developer container for storing a developer including the toner and a magnetic carrier;

a toner supply port that leads the toner supplied from the toner supply device into the developer container; and, a toner supply sensor arranged near the toner supply port to detect the amount of toner supply, the toner supply device includes a storage for recording the amount of toner supply detected by the toner supply sensor every time a toner supply operation is made, and, the toner supply controller corrects the amount of toner supplied from the toner supply device to the developing device, based on the moving average of multiple toner supplies recorded in the storage.

2. The image forming apparatus according to claim 1, wherein the moving average is the average of multiple toner supplies detected from the latest multiple toner supply operations.

3. The image forming apparatus according to claim 1, wherein the toner supply sensor detects the magnetic permeability of the developer residing in the developer container.

4. The image forming apparatus according to claim 1, wherein the toner supply device includes:

a toner discharger that turns to discharge the toner inside the toner supply device to the developing device side; and, a drive motor for rotating the toner discharger, and the toner supply controller corrects the amount of toner supply by varying either the rotational rate or rotating time of the drive motor.

5. The image forming apparatus according to claim 1, wherein the storage comprises a non-volatile memory provided in the toner supply device.

6. A toner supply method for an image forming apparatus, the image forming apparatus comprising:

a developing device;

a toner supply device that is detachably mounted to the image forming apparatus and supplies toner to the developing device;

a toner supply controller that controls the toner supply from the toner supply device to the developing device based on predetermined conditions;

a toner empty determiner that determines that no toner is left in the toner supply device when the amount of toner supplied from the toner supply device to the developing device is lower than a threshold, wherein the developing device comprises:

a developer container for storing a developer including the toner and a magnetic carrier;

a toner supply port that leads the toner supplied from the toner supply device into the developer container; and, a toner supply sensor arranged near the toner supply port to detect the amount of toner supply, the toner supply device includes a storage for recording the amount of toner supply detected by the toner supply sensor every time a toner supply operation is made, and, the toner supply controller corrects the amount of toner supplied from the toner supply device to the developing device, based on the moving average of multiple toner supplies recorded in the storage, the toner supply method comprising the steps of:

recording the amount of supplied toner detected by the toner supply sensor every time a toner supply operation is made; and, correcting the amount of toner to be supplied from the toner supply to the developing device, based on the moving average.

* * * * *